United States Patent [19]

Hansen

[11] Patent Number: 4,812,144

[45] Date of Patent: Mar. 14, 1989

[54] FLAME-RESISTANT NYLON/COTTON FABRIC AND PROCESS FOR PRODUCTION THEREOF

[75] Inventor: John H. Hansen, Greensboro, N.C.

[73] Assignee: Burlington Industries, Inc., Greensboro, N.C.

[21] Appl. No.: 70,559

[22] Filed: Jul. 7, 1987

[51] Int. Cl.[4] ..... C09B 67/00

[52] U.S. Cl. ..... 8/584; 106/18.19; 427/393.3; 427/223; 8/127.1; 8/181

[58] Field of Search ..... 8/181, 127.1, 584; 427/393.3, 223; 106/18.19

[56] References Cited

U.S. PATENT DOCUMENTS

| | | | |
|---|---|---|---|
| 3,789,091 | 1/1974 | Anderson | 260/927 R |
| 3,849,368 | 11/1974 | Anderson | 260/45.8 R |
| 4,139,476 | 2/1979 | Hancock | 252/8.1 |
| 4,237,157 | 12/1980 | Hancock | 427/352 |
| 4,397,759 | 8/1983 | Hancock | 252/609 |

OTHER PUBLICATIONS

"Antiblaze 19" Data Sheet.

*Primary Examiner*—A. Lionel Clingman
*Assistant Examiner*—John F. McNally
*Attorney, Agent, or Firm*—Nixon & Vanderhye

[57] ABSTRACT

Nylon/cotton blend fabrics containing at least 40% by weight of nylon are rendered flame resistant and durable to multiple launderings in a two step process in which a THP/urea precondensate/ammonia polymer network is formed within the cotton fiber structure then durability is enhanced in a second step 1 which a flame resistant cyclic phosphonate ester and a THP salt plus urea are applied. Durability up to 50 multiple washings and continued flame resistance for these nylon/cotton blend fabrics are reported.

8 Claims, No Drawings

FLAME-RESISTANT NYLON/COTTON FABRIC AND PROCESS FOR PRODUCTION THEREOF

FIELD OF THE INVENTION

This invention relates to flame-resistant fabrics made of blends of cotton and nylon and procedures for preparing such fabrics.

BACKGROUND OF THE INVENTION

It is difficult to finish a high, that is substantially 50/50 or greater, nylon/cotton fabric with a flame retardant and have acceptable flame resistance properties coupled with durability after multiple washings. One flame retardant process suitable only for cotton fibers which provides satisfactory and durable flame resistance, known as the PROBAN process, consists of treating the cotton fabric with a prepolymer of tetrakis-(hydroxymethyl)phosphonium salt and urea, followed by ammoniation (THP/urea-precondensate/ammonia). The PROBAN process, licensed by Albright & Wilson, is described in the following U.S. Pat. Nos.: 4,078,101; 4,145,463; 4,311,855; and 4,494,951, all to Albright & Wilson, the disclosures of which are hereby incorporated by reference to the extent necessary to explain the THP salt/urea precondensate process. See also U.S. Pat. No. 4,346,031 to Elgal et al. This process is considered effective and is widely promoted by at least two companies for imparting flame resistance to 100% cotton fabrics; it is not promoted or advertised for polyester/cotton blends or nylon/cotton blends.

The amount of flame retardant chemical that would be present for different nylon/cotton blends can be calculated. For example, assume that THF/urea-precondensate/ammonia was used on 100% cotton fibers and that 3 wt.% phosphorus was fixed. This amount of phosphorus would be above the amount that would be expected to be required for good flame resistance of cotton fibers alone. However, if these flame-retardant-treated cotton fibers were then blended with nylon fibers to obtain a 55/45 nylon/cotton fabric, the "effective" phosphorus concentration of the blend would be only about 1.3 wt.%. Thus, a PROBAN-type process, in which only the cotton is treated, might be used successfully with lower nylon/cotton blends containing only a small amount of nylon up to 15/85, where such a process would result in an "effective" phosphorus concentration of the 15/85 nylon/cotton blend of about 2.4 wt.%. This concentration is adequate for good flame resistance.

It has been observed that if other compatible flame retardants, such as the cyclic phosphonate esters, as exemplified by Antiblaze 19 (identified in more detail below), are applied to the nylon fibers of a higher-nylon nylon/cotton blend, a satisfactory level of flame resistance can be obtained initially. However, the flame resistance is substantially reduced after about 15 launderings, because the cyclic phosphonate esters are not substantive to the nylon. Therefore, it was recognized that flame retardant chemicals for nylon fibers must somehow be made to perform better in order to produce a flame resistant high-nylon nylon/cotton blend fabric that retains enough total phosphorus for good flame resistance after multiple washings, thereby providing both satisfactory flame resistance and durability for a nylon/cotton blend fabric.

One such improved flame retardant system for nylon/cotton fabrics was developed using a one-step, two component system, one component for the nylon fibers and the other for the cotton fibers. The process, as described in copending application Ser. No. 911,729, consists of treating the nylon/cotton fabric with a finish containing both Antiblaze 19, for the nylon fibers, and tetrakis-(hydroxymethyl)phosphonium sulfate and urea (THPS/urea), for the cotton fibers. Flame resistant nylon/cotton fabrics prepared by this process showed improved flame resistance durability as compared with applying the THPS/urea and Antiblaze 19 separately as described in commonly-assigned application Ser. No. 870,892 filed June 5, 1986. However, it was not possible to obtain optimum flame resistance, durability, and an acceptable hand by this process for nylon/cotton blends containing more than 40% nylon.

Thus, with these processes, flame resistance of the fabric was adequate when tested, assessed by FTM 5903, initially, but was reduced to an unsatisfactory level after 15 or so washings either because the amount of phosphorus which can be fixed on the blend by the flame retardant process was limited or because the flame resistance durability or the hand was not adequate for nylon/cotton blends containing more than 40% nylon.

SUMMARY OF THE INVENTION

The object of the present invention is to produce a flame-resistant nylon/cotton fabric, particularly a nylon/cotton blend in which the nylon content is in excess of 40%, having improved durability of flame resistance by means of a two-step application process. The first step is to maximize the location of the flame retardant chemicals inside the cotton fibers in order that enough total phosphorus for good flame resistance be present, and the second step, similar to that described in copending application Ser. No. 911,720, is intended to provide adequate durability to the nylon/cotton blend.

It is now proposed that the durability of the flame resistance of high-nylon nylon/cotton fabrics can be further improved by applying the THP/urea-precondensate/ammonia treatment prior to the improved durability one-step process, as described in copending application Ser. No. 911,720 of applying Antiblaze 19, which protects the nylon fibers, and the THPS/urea to protect both the cotton fibers and the nylon.

DETAILED DESCRIPTION OF THE INVENTION

The THP/urea-precondensate/ammonia process consists of applying a THP/urea-precondensate to cotton fabric and drying the fabric to about 10 to 15 wt.% of moisture. The cotton fabric is then exposed to gaseous ammonia. The precondensate is insolubilized by the ammonia. Fixation of the precondensate takes place mainly inside of the cotton fiber, thus imparting durability to multiple launderings. However, attempts made in the past to use this process to finish nylon/cotton fabric have not been fully successful when the nylon fiber content was high.

While there is an upper limit for the amount of the flame retardant chemical that can be packed in the cotton fiber by the THP/urea-precondensate/ammonia process, techniques can be used to maximize that amount. It is generally believed that approximately 3 weight percent of phosphorus in the form of the THP/urea-precondensate/ammonia complex can be fixed inside of the cotton fiber, but the actual amount will depend on the prior history of the fiber. However, the fixation of the flame retardant polymer on the inside of the cotton fibers provides little protection to the nylon fibers. Therefore, the nylon fibers would still need an additional chemical treatment to provide adequate flame resistance to the nylon/cotton fabric.

The subject invention consists of first applying an optimized amount of the reactants of the THP/urea-precondensate/ammonia system to maximize the location of the flame retardant chemicals inside the cotton fibers in order that enough total phosphorus for good flame resistance be present. This optimum amount depends on the blend level as well as the prior history of the cotton fiber. The treated fabric is then dried at a low temperature to about 15% residual moisture, treated with excess gaseous ammonia, then oxidized in a bath of aqueous hydrogen peroxide. Following this first flame retardant treatment, the fabric is finished in a second step with a cyclic phosphonate ester (as defined herein), for the nylon component of the nylon/cotton fabric, and an additional amount of the THP-type of chemical (fixed by the THPS/urea system) for both components of the nylon/cotton fabric. The actual amount applied is expected to depend on the blend level, with the blends having a higher nylon content requiring higher levels of the cyclic phosphonate ester for good flame resistance. The fabric is then oxidized again with aqueous hydrogen peroxide.

A number of experiments have been conducted demonstrating the process of the subject invention on a 55/45 nylon/cotton blend. Indeed, it was found that the flame resistance for high-nylon nylon/cotton blends remained high after as many as 50 wash cycles in a home washing machine at 130° F., using Tide-type detergent.

The process of this invention can be used on a wide range of nylon/cotton blends. Nylon/cotton fabrics treated contained about 55% of nylon and it is expected that nylon/cotton fabrics with less nylon will also exhibit good flame resistance durability. The minimum nylon content is 40% by weight. The maximum nylon/cotton fiber ratio which can be treated without reducing flame resistance to undesirable levels can be determined experimentally.

Preliminary studies indicate that there appears to be an optimum amount of each flame retardant in the combination as established in the experimental studies that follow. With the particular nylon/cotton fabrics tested, best results were obtained when fabrics were treated first with about 22% (owf) of the THP/urea-precondensate, then with about 23% THPS/6% urea and the cyclic phosphonate ester. This optimum may well vary with blend ratio and fabric weight, and can be conveniently determined through a series of experiments to identify an optimum range for a given fabric and/or set of treatment conditions. Some dependence of flame resistance durability upon fabric weight has been observed, with heavier fabrics being less resistant.

Cotton fabrics have been treated in the past with tetrakis-(hydroxymethyl)phosphonium hydroxide (THPOH), in place of the THP/urea-precondensate, followed by ammoniation. THPOH is expected to be effective in the process of the subject invention, although control of the THPOH reaction is more difficult.

In the preferred embodiments and examples, both the THP/urea-precondensate finish composition and the THPS/urea and Antiblaze 19 finish composition contain minor amounts of surfactants. In addition, the THPS/urea/Antiblaze 19 finish composition also contains a buffering salt and a fabric softener. The optimum concentrations for these adjunct components, or of alternate materials, can be determined empirically.

Certain process variables may be important factors and these will be realized through experience with the process. With cotton fabrics, the amount of moisture in the fabric at the time it is ammoniated is known to be important. The drying process itself and the lag time between finish application and ammoniation may also affect placement of the flame retardant and, consequently, its effectiveness. Drying and curing of the THPS/urea and Antiblaze 19 are also the subject of variations for optimization.

The two-step process of the subject invention provides the capability of producing flame resistant nylon/cotton fabrics with better durability through multiple launderings than other known processes. The resulting flame-resistant, lightweight, high-nylon-containing blends having flame-resistant properties durable to multiple launderings cannot otherwise be produced.

The nylon/cotton fibrous materials which can be provided with a flame-retardant finish according to the invention can be in any desired stage of processing, i.e., they can be treated as woven or knitted fabrics, dyed or undyed, or as textiles which have already been further processed.

The invention will now be illustrated with reference to the following examples in which all parts and percentages are by weight and temperatures reported in degrees Fahrenheit, unless otherwise indicated. The materials used are more fully described as follows:

Among the flame-retardant materials used in accordance with the present invention are thermally stable cyclic phosphonate esters prepared by reacting alkyl-halogen-free esters with a bicyclic phosphite. As a class, these cyclic phosphonate esters are represented by one of the formulas:

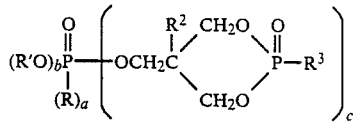

(A)

where a is 0 or 1; b is 0, 1 or 2, c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

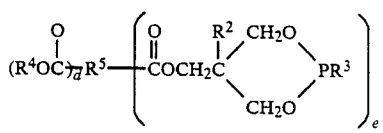

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or triavalent phenyl.

The preferred compounds (see below) are represented by the formula:

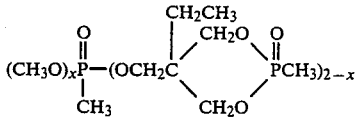

(C)

in which X is 0 or 1, and usually a 50:50 mixture of the mono- and di-esters. The preparation of these cyclic phosphonate esters and their use as flame retardants are described in U.S. Pat. No. 3,789,091 and 3,849,368, the disclosures of which are hereby incorporated by reference.

Antiblaze 19T, as described by the supplier Albright & Wilson, Inc., of Richmond, Va., is a cyclic phosphonate ester, available as an odorless viscous liquid (viscosity 6000 SMS at 100° F.) with a flashpoint of 340° F. (ASTM D-93).

Tetrakis-(hydroxymethyl)phosphonium sulfate (THPS), also available from Albright & Wilson, Inc., under the name of Retardol S, is a pale, straw-colored liquid that is miscible with water and has a pungent odor. Several related compounds can be used in place of THPS, including tetrakis(hydroxymethyl)phosphonium chloride (THPC), available under the name of Retardol C from Albright & Wilson, and tetrakis-(hydroxymethyl)phosphonium oxalate, available as Pyroset TKS from American Cyanimid Company.

THPS when mixed with urea and heated strongly forms a relatively insoluble polymer, containing both phosphorus and nitrogen, inside the cotton fibers, and around both the cotton and the nylon fibers. Insolubility of this polymer is increased further by oxidizing the phosphorus with hydrogen peroxide.

Aerotex H is described by its supplier, American Cyanamid, Co., as a cationic product with nonionic and anionic moieties, and is included in the pad bath formulation as a softener.

Tergitol TMN-10 is ethoxylated 2,6,8-trimethylnonanol, commercially available from Union Carbide Corporation.

FLAME RESISTANCE TESTING METHOD

The following testing procedure was used:

FR Federal Test Method 5903 is intended for use in determining the resistance of cloth to flame and glow propagation and tendency to char. A rectangular cloth test specimen (70 mm×305 mm) with the long dimension parallel to the warp or fill direction is placed in a holder and suspended vertically in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen may continue to flame after the burner is extinguished. The time in seconds the specimen continues to glow after the specimen has ceased to flame is reported as afterglow time; if the specimen glows for more than 30 seconds; it is removed from the test cabinet, taking care not to fan the glow, and suspended in a draft-free area in the same vertical position as in the test cabinet. Char length, the distance (in inches) from the end of the specimen, which was exposed to the flame, to the end of a lengthwise tear through the center of the charred area to the highest peak in the charred area, is also measured. Five specimens from each sample are usually measured and the results averaged.

EXAMPLE I

A nylon/cotton (52/48) blend fabric, 5.1 oz/sq yd, was previously printed with a woodland camouflage pattern. Samples of this fabric were padded with the THP/urea-precondensate finishes listed below (components listed in percent by weight), then dried at 129° F. in a Benz oven for 31–33 seconds. Moisture content of the samples, measured with a Mahlo TextoMeter, was 14–15%.

| | Bath 1 | Bath 2 | Bath 3 |
|---|---|---|---|
| Tergitol TNM-10 | 0.1 | 0.1 | 0.1 |
| Sodium acetate | 3.0 | 3.0 | 3.0 |
| Retardol AC | 34.0 | 42.0 | 50.0 |
| Water | 62.9 | 54.9 | 46.9 |
| Wet Pickup Check | 59% | 61 | 60 |

After equilibrating overnight, the damp samples were treated individually with ammonia in a closed laboratory reactor. After placing a sample in the reactor and replacing the cover, ammonia gas was allowed to flow into the reactor for 3 minutes at a rate of 110 scfh. The sample was then removed and the reactor flushed with air for 2 minutes before a new sample was inserted.

The samples were next oxidized in a large vat of warm water containing about 15% hydrogen peroxide on weight of fabric. After 5 minutes of treatment, sodium carbonate was added to increase the pH of the solution to 9–10 and the treatment continued for another 5 minutes. The samples were rinsed several times with fresh water, and centrifuged and tumble-dried.

The samples were then padded with the THPS/urea and cyclic phosphonate ester-containing finishes shown below, then dried and cured at 360° F. for 70 seconds in a Benz oven. In this formulation, disodium phosphate is the buffered salt.

| | Bath A | Bath B | Bath C |
|---|---|---|---|
| Tergitol TMN-10 | 0.1 | 0.1 | 0.1 |
| Disodium phosphate | 2.0 | 2.0 | 2.0 |
| Urea | 7.8 | 10.4 | 13.0 |
| Retardol S | 30.0 | 40.0 | 50.0 |
| Antiblaze 19-T | 10.0 | 10.0 | 10.0 |
| Aerotex H | 2.0 | 2.0 | 2.0 |
| Water | 48.1 | 35.5 | 22.9 |

Samples were treated in the pattern shown below:

| Code | Precondensate Bath | THPS/Urea Bath | Wet Pickup |
|---|---|---|---|
| 1A | 1 | A | 67% |
| 1B | 1 | B | |
| 1C | 1 | C | |
| 2A | 2 | A | |
| 2B | 2 | B | 66 |
| 2C | 2 | C | |
| 3A | 3 | A | |
| 3B | 3 | B | |
| 3C | 3 | C | 69 |

The samples were oxidized in the manner described above, rinsed several times and allowed to hang overnight to dry. Portions of the fabrics were then laundered in a home washing machine at about 130° F., using a Tide-type detergent. After drying, laundered fabrics were tested for flame resistance by FTM 5903, using 3 warp direction and 3 fill direction specimens for each test.

| | As finished | | 25 Launderings | | 50 Launderings | |
|---|---|---|---|---|---|---|
| Code | BEL | Char | BEL | Char | BEL | Char |
| 1A | | 4.67 | 1 | 5.88 | 4 | 6.65 |
| 1B | | 4.32 | | 4.85 | 1 | 5.34 |
| 1C | | 3.60 | | 4.54 | 1 | 4.70 |
| 2A | | 4.05 | 2 | 4.72 | | 5.62 |
| 2B | | 3.67 | | 4.08 | | 5.03 |
| 2C | | 3.55 | | 3.87 | | 4.55 |
| 3A | | 4.28 | | 4.92 | 1 | 5.96 |
| 3B | | 3.80 | 1 | 4.56 | | 5.15 |
| 3C | | 3.27 | | 4.30 | | 4.58 |

In this Table, BEL indicates that entire length of specimen burned.

Char is average length (reported in inches) of burned area in the remaining specimens (excludes the BEL's).

Phosphorus contents of the fabrics were also measured by ASTM D1091-54T (photometric) a procedure which involved Kjeldahl digestion of specimens and analysis by a colorimetric method.

| Code | P, % As-Finished | P, % 25 Launderings | P, % 50 Launderings |
|---|---|---|---|
| 1A | 3.09 | 2.67 | 2.52 |
| 1B | 3.71 | 3.08 | 2.88 |
| 1C | 4.14 | 3.48 | 3.30 |
| 2A | 3.49 | 2.98 | 2.85 |
| 2B | 3.99 | 3.52 | 3.28 |
| 2C | 4.32 | 3.70 | 3.58 |
| 3A | 3.80 | 3.18 | 3.01 |
| 3B | 4.13 | 3.58 | 3.45 |
| 3C | 4.76 | 3.98 | 3.71 |

Phosphorus content, as a measure of flame retardant substantive on the fiber, remained high after 25 and even 50 launderings with phosphorus quantities at about 75% of as-finished values prior to laundering. Similarly performance was observed in the flame resistance testing.

EXAMPLE II

Fabric used in this example was a nylon/cotton (53/47) blend, 8.1 oz/sq yd, printed with a woodland camouflage pattern. Samples of this fabric were padded with the THP/urea-precondensate finishes listed in Example I and then dried at 131° F. in a Benz oven for 57–58 seconds. Moisture content of the samples, measured with a Mahlo TextoMeter, was 13–14.5%. Wet pickup checks were 52, 52 and 53%, respectively, with Baths 1, 2 and 3. Samples were ammoniated and oxidized as described in the previous example.

The samples were then padded with the THPS/urea finishes listed in Example I, then dried and cured at 360° F. for 70 seconds in a Benz oven. Measured wet pickups are shown below:

| Code | Wet Pickup |
|---|---|
| 1A | 55% |
| 2A | 55 |

-continued

| Code | Wet Pickup |
|---|---|
| 3A | 52 |
| 1B | 57 |
| 2B | 56 |
| 3B | 56 |
| 1C | 58 |
| 2C | 58 |
| 3C | 56 |

Samples were oxidized, rinsed and dried, then laundered as above. Flame resistances were measured by FTM 5903 using 4 warp direction and 6 fill direction specimens in each test.

| | As finished | | 25 Launderings | | 50 Launderings | |
|---|---|---|---|---|---|---|
| Code | BEL | Char | BEL | Char | BEL | Char |
| 1A | 5 | 5.86 | 8 | 6.90 | 10 | — |
| 1B | 1 | 5.11 | 4 | 6.91 | 9 | 6.8 |
| 1C | 1 | 4.18 | 2 | 5.00 | 6 | 5.48 |
| 2A | | 5.50 | 8 | 6.85 | 9 | 7.2 |
| 2B | | 4.68 | 5 | 5.22 | 6 | 5.92 |
| 2C | 1 | 4.42 | 4 | 5.38 | 2 | 5.59 |
| 3A | 1 | 4.84 | 8 | 6.00 | 7 | 6.8 |
| 3B | | 4.78 | 2 | 5.75 | 6 | 5.42 |
| 3C | 3 | 3.76 | 5 | 5.68 | 5 | 5.46 |

Measured phosphorus contents were:

| Code | As finished | 25 Launderings | 60 Launderings |
|---|---|---|---|
| 1A | 2.54 | 2.47 | 2.47 |
| 1B | 3.01 | 2.97 | 2.74 |
| 1C | 3.24 | 3.23 | 2.84 |
| 2A | 2.68 | 2.67 | 2.64 |
| 2B | 3.48 | 3.12 | 3.07 |
| 2C | | 3.31 | 3.30 |
| 3A | 3.35 | 2.98 | 2.92 |
| 3B | 3.68 | 3.43 | 3.22 |
| 3C | 3.95 | | 3.50 |

The above data demonstrate durability to multiple launderings of the flame retardant finish on nylon/cotton blend fabrics in which the nylon content is at least 40% of the weight of the fabric. Phosphorus content on such fabrics treated according to the present invention is at least 2.4% and preferably at least 3.0% phosphorus as measured by ASTM D1091-54T.

What is claimed is:

1. A process for imparting flame resistance to nylon/cotton blend fabric containing at least 40% by weight nylon, comprising the successive steps of:

(1) applying to the fabric a flame-retarding amount of a prepolymer condensate of urea and a tetrakis(hydroxymethyl)phosphonium salt flame retardant that fixes to the cotton fibers, drying the fabric to at most about 20% by weight of moisture, exposing the prepolymer condensate-containing fabric to a source of ammonia to form a flame-retardant polymer network within the cotton fiber structure, then oxidizing the fabric to further improve flame resistance and enhance durability to multiple launderings, and then (2) applying an additional flame-retarding amount of (i) a cyclic phosphonate ester represented by the formula:

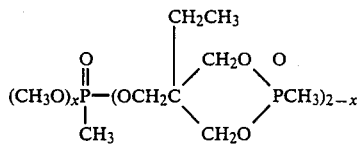

in which x is 0 or 1, that fixes onto the nylon fibers in combination with (ii) a tetrakis(hydroxymethyl)-phosphonium salt and urea to the fabric, heating the fabric to form an insoluble phosphorus-containing polymer in and on the cotton then oxidizing the fabric to further improve the flame resistance and enhance durability to multiple launderings, the thus-treated fabric having at least 2.4% phosphorus, as measured by ASTM D1091-54T, fixed to the fibers after 50 launderings, steps (1) and (2) conducted in the order stated.

2. The process of claim 1 in which the fabric contains at least 40% by weight nylon, balance substantially entirely cotton.

3. The process of claim 1 in which the fabric prior to exposure to ammonia in step (1) is dried to a moisture content in the range of from about 10% to about 15% by weight.

4. The process of claim 1 in which the tetrakis(hydroxymethyl)phosphonium salt is the chloride salt.

5. The process of claim 1 in which the tetrakis(hydroxymethyl)phosphonium salt is the sulfate salt.

6. The process of claim 1 in which the tetrakis(hydroxymethyl)phosphonium salt is the oxalate salt.

7. The process of claim 1 in which the tetrakis(hydroxymethyl)phosphonium salt is the phosphate salt.

8. A flame-resistant nylon/cotton blend fabric containing at least 40% by weight of nylon, balance substantially cotton, having at least 3.0% phosphorus as measured by ASTM D1091-54T fixed to the fibers after 50 launderings.

* * * * *